US006703353B1

(12) United States Patent
Lok et al.

(10) Patent No.: US 6,703,353 B1
(45) Date of Patent: Mar. 9, 2004

(54) BLENDING OF LOW VISCOSITY FISCHER-TROPSCH BASE OILS TO PRODUCE HIGH QUALITY LUBRICATING BASE OILS

(75) Inventors: Brent K. Lok, San Francisco, CA (US); Russell R. Krug, Novato, CA (US); John M. Rosenbaum, Richmond, CA (US); Joseph Pudlak, Vallejo, CA (US); Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/235,150

(22) Filed: Sep. 4, 2002

(51) Int. Cl.[7] ..... C10M 105/02

(52) U.S. Cl. ..... 508/110; 208/18; 208/19; 208/950

(58) Field of Search ..... 208/18, 19, 950; 508/110

(56) References Cited

U.S. PATENT DOCUMENTS

| | | | |
|---|---|---|---|
| 2,668,790 | A | 2/1954 | Good et al. |
| 2,668,866 | A | 2/1954 | Good et al. |
| 4,812,246 | A | 3/1989 | Yabe |
| 4,906,350 | A | 3/1990 | Lucien et al. |
| 5,135,638 | A | 8/1992 | Miller |
| 6,008,164 | A | 12/1999 | Aldrich et al. |
| 6,059,955 | A | 5/2000 | Cody et al. |
| 6,080,301 | A | 6/2000 | Berlowitz et al. |
| 6,090,989 | A | 7/2000 | Trewella et al. |
| 6,096,940 | A | 8/2000 | Wittenbrink et al. |
| 6,165,949 | A | 12/2000 | Berlowitz et al. |
| 6,332,974 | B1 | 12/2001 | Wittenbrink et al. |

FOREIGN PATENT DOCUMENTS

| | | |
|---|---|---|
| EP | 0 515 256 B1 | 3/1997 |
| EP | 0 776 959 A3 | 6/1997 |
| WO | WO 99/41335 | 8/1999 |
| WO | WO 00/08115 | 2/2000 |
| WO | WO 00/14179 | 3/2000 |
| WO | WO 00/14187 | 3/2000 |
| WO | WO 02/070629 A1 | 9/2002 |

OTHER PUBLICATIONS

"Platforming of Paraffin Wax", Journal of the Institute of Petroleum, 1956, vol. 43, pp. 205–216 by Schenk et al., University of Chemcial Engineering, Delft.

"Hydro–Isomerization of Paraffin Wax", Journal of the Institute of Petroleum, vol. 43, No. 407, pp. 297–306, Nov. 1957 by Breimer et al., University of Chemcial Engineering, Delft, Holland.

*Primary Examiner*—Ellen M. McAvoy
(74) *Attorney, Agent, or Firm*—James W. Ambrosius

(57) ABSTRACT

A process for preparing Fischer-Tropsch derived lubricating base oils by blending a Fischer-Tropsch distillate fraction having a viscosity of 2 or greater but less than 3 cSt at 100 degrees C. with at least one additional Fischer-Tropsch derived distillate fraction having a viscosity of greater than 3.8 cSt at 100 degrees C.; lubricating base oil compositions having a viscosity between about 3 and about 10 cSt at 100 degrees C. and a TGA Noack volatility of less than about 35 weight percent; and finished lubricants using the aforesaid lubricating base oils.

60 Claims, No Drawings

BLENDING OF LOW VISCOSITY FISCHER-TROPSCH BASE OILS TO PRODUCE HIGH QUALITY LUBRICATING BASE OILS

FIELD OF THE INVENTION

The invention relates to the blending of a low viscosity Fischer-Tropsch derived base oil fraction with a higher viscosity Fischer-Tropsch derived base oil fraction to produce a high quality lubricating base oil that is useful for preparing commercial finished lubricants such as crankcase engine oils.

BACKGROUND OF THE INVENTION

Finished lubricants used for automobiles, diesel engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including original equipment manufacturers (OEM's), the American Petroleum Institute (API), Association des Consructeurs d' Automobiles (ACEA), the American Society of Testing and Materials (ASTM), and the Society of Automotive Engineers (SAE), among others, define the specifications for lubricating base oils and finished lubricants. Increasingly, the specifications for finished lubricants are calling for products with excellent low temperature properties, high oxidation stability, and low volatility. Currently only a small fraction of the base oils manufactured today are able to meet these demanding specifications.

Syncrudes prepared from the Fischer-Tropsch process comprise a mixture of various solid, liquid, and gaseous hydrocarbons. Those Fischer-Tropsch products which boil within the range of lubricating base oil contain a high proportion of wax which makes them ideal candidates for processing into lubricating base oil stocks. Accordingly, the hydrocarbon products recovered from the Fischer-Tropsch process have been proposed as feedstocks for preparing high quality lubricating base oils. When the Fischer-Tropsch waxes are converted into Fischer-Tropsch base oils by various processes, such as hydroprocessing and distillation, the base oils produced fall into different narrow-cut viscosity ranges. Typically, the viscosity of the various cuts will range between 2.1 cSt and 12 cSt at 100 degrees C. Since the viscosity of lubricating base oils typically will fall within the range of from 3 to 32 cSt at 100 degrees C., the base oils that fall outside of this viscosity range have limited use and, consequently, have less market value for engine oils.

The Fischer-Tropsch process typically produces a syncrude mixture containing a wide range of products having varying molecular weights but with a relatively high proportion of the products characterized by a low molecular weight and viscosity. Therefore, usually only a relatively low proportion of the Fischer-Tropsch products will have viscosities above 3 cSt at 100 degrees C. which would be useful directly as lubricating base oils for the manufacture of commercial lubricants, such as engine oil. Currently, those Fischer-Tropsch derived base oils having viscosities below 3 cSt at 100 degrees C. have a limited market and are usually cracked into lower molecular weight material, such as diesel and naphtha. However, diesel and naphtha have a lower market value than lubricating base oil. It would be desirable to be able to upgrade these low viscosity base oils into products suitable for use as a lubricating base oil.

Conventional base oils prepared from petroleum derived feedstocks having a viscosity below 3 cSt at 100 degrees C. have a low viscosity index (VI) and high volatility. Consequently, low viscosity conventional base oils are unsuitable for blending with higher viscosity conventional base oils because the blend will fail to meet the VI and volatility specifications for most finished lubricants. Surprisingly, it has been found that Fischer-Tropsch derived base oils having a viscosity above 2 and below 3 cSt at 100 degrees C. display unusually high VI's, resulting in excellent low temperature properties and volatilities similar to those seen in conventional Group I and Group II Light Neutral base oils which have a viscosity generally falling in the range of between 3.8 and 4.7 cSt at 100 degrees C. Even more surprising was that when the low viscosity Fischer-Tropsch derived base oils were blended with certain higher viscosity Fischer-Tropsch derived lubricating base oils, a VI premium was observed, i.e., the VI of the blend was significantly higher than would have been expected from a mere averaging of the VI's for the two fractions. As explained in more detail below, in some instances the VI of the blend actually exceeded the individual VI of either of the fractions used to prepare the blend. Consequently, it is has been discovered that both the low and high viscosity Fischer-Tropsch base oils may be advantageously employed as blending stock to prepare premium lubricants.

While Fischer-Tropsch derived lubricating base oil blends have been described in the prior art, the method used to prepare them and the properties of the prior art blends differ from the present invention. See, for example, U.S. Pat. Nos. 6,332,974; 6,096,940; 4,812,246; and 4,906,350. It has not been previously taught that Fischer-Tropsch fractions having a viscosity of less than 3 cSt at 100 degrees C. could be used to prepare lubricating base oils suitable for blending finished lubricants meeting the specifications for SAE Grade 0W, 5W, 10W, and 15W multigrade engine oils; automatic transmission fluids; and ISO Viscosity Grade 22, 32, and 46 industrial oils. With the present invention, this becomes possible.

When referring to conventional lubricating base oils this disclosure is referring to conventional petroleum derived lubricating base oils produced using petroleum refining processes well documented in the literature and known to those skilled in the art.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a process for producing a Fischer-Tropsch derived lubricating base oil which comprises (a) recovering a Fischer-Tropsch derived product; (b) separating the Fischer-Tropsch derived product into at least a first distillate fraction and a second distillate fraction, said first distillate fraction being characterized by a viscosity of about 2 cSt or greater but less than 3 cSt at 100 degrees C. and said second distillate fraction being characterized by a viscosity of about 3.8 cSt or greater at 100 degrees C.; and (c) blending the first distillate fraction with the second distillate fraction in the proper proportion to produce a Fischer-Tropsch derived lubricating base oil characterized as having a viscosity of between about 3 and about 10 cSt at 100 degrees C. and a TGA Noack volatility of less than about 35 weight percent. Lubricating base oils prepared using the process of the invention have been prepared which meet the specifications for a premium lubricating base oil. Due to the excellent characteristics of the Fischer-Tropsch derived lubricating base oils, it is also possible to add to the blend a Fischer-Tropsch derived bottoms fraction generally having a viscosity between about 9 cSt and about 20 cSt, preferably between about 10 cSt and 16 cSt, and still meet the various specifications for a lubricating base oil intended for use in preparing a premium engine oil. The invention makes it possible to upgrade both low and high viscosity Fischer-Tropsch derived base oils into more valuable premium lubricants which otherwise would be cracked or blended into lower value transportation fuels.

The Fischer-Tropsch lubricating base oil blends prepared using the process of the present invention are unique, and will display certain specifications which may be used to distinguish the blends from both conventional and Fischer-Tropsch derived lubricating base oils disclosed in the prior art. For example, lubricating base oil blends prepared according to the invention will have a TGA Noack volatility of greater than about 12 and more generally will have a TGA Noack volatility in excess of about 20. The blends also typically will display a VI of between about 130 and about 175 and will have a very low total sulfur content, usually less than about 5 ppm. In addition, the lubricating base oils compositions of the invention display unique boiling range distributions.

The boiling range distributions characteristic of the lubricating base oils prepared according to the invention will depend to some extent on the viscosity of the second distillate fraction used in the blend. For example, when the second distillate fraction used to prepare the blend has a viscosity within the range from about 7 to about 12 cSt at 100 degrees C., the Fischer-Tropsch derived lubricating base oil will have an initial boiling point within the range of between about 550 degrees F. (288 degrees C.) and about 625 degrees F. (329 degrees C.), an end boiling point between about 1000 degrees F. (538 degrees C.) and about 1400 degrees F. (760 degrees C.), and wherein less than 20 weight percent of the blend boils within the region defined by the 50 percent boiling point, plus or minus 25 degrees F. In this instance the blend will have a boiling range distribution between the 5 percent and 95 percent points of at least 350 degrees F. (194 degrees C.), commonly of at least 400 degrees F. (222 degrees C.). When the second distillate fraction used to prepare the blend has a viscosity within the range of about 3.8 cSt and about 8.5 cSt at 100 degrees C., the Fischer-Tropsch derived lubricating base oil typically will have a boiling range distribution of at least 300 degrees F. (167 degrees C.) between the 5 percent and 95 percent points. All boiling range distributions in this disclosure are measured using the standard analytical method D-6352 or its equivalent unless stated otherwise. As used herein, a equivalent analytical method to D-6352 refers to any analytical method which gives substantially the same results as the standard method.

The Fischer-Tropsch derived lubricating base oils prepared according to the present invention may be blended with conventionally derived lubricating base oils, such as conventional Neutral Group I and Group II lubricating base oils. When the Fischer-Tropsch derived lubricating base oil is blended with a conventional Neutral Group I or Group II base oil, the conventional base oil will typically comprise between about 40 weight percent and about 90 weight percent of the total blend, with from about 40 weight percent to about 70 weight percent being preferred. A finished lubricant, such as, for example, a commercial multi-grade crankcase lubricating oil meeting SAE J300, June 2001 specifications, may be prepared from the lubricating base oil blends of the invention by the addition of the proper additives. Typical additives added to a lubricating base oil blend when preparing a finished lubricant include anti-wear additives, detergents, dispersants, antioxidants, pour point depressants, VI improvers, friction modifiers, demulsifiers, antifoaming agents, corrosion inhibitors, seal swell agents, and the like. In addition, commercial products meeting SAE standards for gear lubricants and ISO Viscosity Grade standards for industrial oils may be prepared from the Fischer-Tropsch derived lubricating base oils of the invention.

DETAILED DESCRIPTION OF THE INVENTION

Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. Due to the high volatility of conventional low viscosity oils with kinematic viscosities below 3 cSt at 100 degrees C., they have limited their use in passenger car engine oils. Any new lubricating base oil stocks developed for use in automotive engine oils should have a volatility no greater than current conventional Group I or Group II Light Neutral oils.

Fischer-Tropsch wax processing typically produces a relatively high proportion of products of low molecular weight and low viscosity that are processed into light products such as naphtha, gasoline, diesel, fuel oil, or kerosene. A relatively small proportion of products have viscosities above 3.0 cSt which are useful directly as lubricating base oils for many different products, including engine oils. Those base oils with viscosities between 2.1 and 2.8 cSt typically are further processed into lighter products (e.g., gasoline or diesel) in order to be of much economic value. Alternatively, these low viscosity Fischer-Tropsch derived base oils may be used in light industrial oils, such as, for example, utility oils, transformer oils, pump oils, or hydraulic oils; many of which have less stringent volatility requirements, and all of which are in much lower demand than engine oils.

Lubricating base oils for use in engine oils are in higher demand than those for use in light products. The ability to use a higher proportion of the products from Fischer-Tropsch processes in lubricating base oil blends for engine oils is highly desirable. By virtue of the present invention, Fischer-Tropsch derived lubricating base oils characterized by low viscosity are blended with medium or high viscosity Fischer-Tropsch distillate fractions to produce compositions which are useful as a lubricating base oils for preparing engine oil. The lubricating base oil stocks of this invention are comparable in volatility and viscosity to conventional Group I and Group II Neutral oils. In addition, lubricating base oils of the invention also have other improved properties, such as very low sulfur and exceptional oxidation stability.

Fischer-Tropsch Synthesis

During Fischer-Tropsch synthesis liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 290 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons with a majority in the $C_5$–$C_{100}$ plus range. The reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in European Patent Application No. 0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

The Fischer-Tropsch derived products used to prepare base oils are usually prepared from the waxy fractions of the Fischer-Tropsch syncrude by hydrotreating or hydroisomerization. Other methods which may be used in preparing the base oils include oligomerization, solvent dewaxing, atmospheric and vacuum distillation, hydrocracking, hydrofinishing, and other forms of hydroprocessing.

Hydroisomerization and Solvent Dewaxing

Hydroisomerization, or for the purposes of this disclosure simply "isomerization", is intended to improve the cold flow properties of the Fischer-Tropsch derived product by the selective addition of branching into the molecular structure. Isomerization ideally will achieve high conversion levels of the Fischer-Tropsch wax to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Isomerization operations suitable for use wisth the present invention typically uses a catalyst comprising an acidic component and may optionally contain an active metal component having hydrogenation activity. The acidic component of the catalysts preferably include an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 5.3 to about 6.5 Angstrom when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having an hydrogenation component, it is usually preferred that the metal be deposited on the catalyst using a non-aqueous method. Non-zeolitic molecular sieves include tetrahedrally-coordinated [AlO2 and PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Solvent dewaxing attempts to remove the waxy molecules from the product by dissolving them in a solvent, such as methyl ethyl ketone, methyl iso-butyl ketone, or toluene, and precipitating the wax molecules and then removing them by filtration as discussed in Chemical Technology of Petroleum, 3rd Edition, William Gruse and Donald Stevens, McGraw-Hill Book Company, Inc., New York, 1960, pages 566–570. See also U.S. Pat. Nos. 4,477,333; 3,773,650; and 3,775,288. In general, with the present invention isomerization is usually preferred over solvent dewaxing, since it results in higher viscosity index products with improved low temperature properties, and in higher yields of the products boiling within the range of the first and second distillate fractions. However solvent dewaxing may be advantageously used in combination with isomerization to recover unconverted wax following isomerization.

Hydrotreating, Hydrocracking, and Hydrofinishing

Hydrotreating refers to a catalytic process, usually carried out in the presence of free hydrogen, in which the primary purpose is the removal of various metal contaminants, such as arsenic; heteroatoms, such as sulfur and nitrogen; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Hydrocracking refers to a catalytic process, usually carried out in the presence of free hydrogen, in which the cracking of the larger hydrocarbon molecules is the primary purpose of the operation. Desulfurization and/or denitrification of the feedstock also usually will occur. In the present invention, cracking of the hydrocarbon molecules is usually undesirable, since the invention is intended as a process for increasing the yield of lubricating base oils which represent the heavier fractions of the Fisher-Tropsch derived syncrude. Accordingly, hydrocracking operations will usually be limited to the cracking of the heaviest bottoms material.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation.

The matrix component can be of many types including some that have acidic catalytic activity. Ones that have activity include amorphous silica-alumina or zeolitic or non-zeolitic crystalline molecular sieves. Examples of suitable matrix molecular sieves include zeolite Y, zeolite X and the so called ultra stable zeolite Y and high structural silica:alumina ratio zeolite Y such as that described in U.S. Pat. Nos. 4,401,556; 4,820,402; and 5,059,567. Small crystal size zeolite Y, such as that described in U.S. Pat. No. 5,073,530 can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO) and 4,913,799 and the various references cited in U.S. Pat. No. 4,913,799. Mesoporous molecular sieves can also be used, for example the M41S family of materials as described in *J. Am. Chem. Soc.*, 114:10834–10843(1992)), MCM-41; U.S. Pat. Nos. 5,246,689; 5,198,203; and 5,334,368; and MCM-48 (Kresge et al., *Nature* 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to dealumination, acid treatment or chemical modification.

In performing the hydrocracking and/or hydrotreating operation, more than one catalyst type may be used in the reactor. The different catalyst types can be separated into layers or mixed.

Hydrocracking conditions have been well documented in the literature. In general, the overall LHSV is about 0.1 $hr^{-1}$ to about 15.0 $hr^{-1}$ (v/v), preferably from about 0.25 $hr^{-1}$ to about 2.5 $hr^{-1}$. The reaction pressure generally ranges from about 500 psia to about 3500 psig (about 10.4 MPa to about 24.2 MPa, preferably from about 1500 psia to about 5000 psig (about 3.5 MPa to about 34.5 MPa). Hydrogen consumption is typically from about 500 to about 2500 SCF per barrel of feed (89.1 to 445 $m^3$ H2/$m^3$ feed). Temperatures in the reactor will range from about 400 degrees F. to about 950 degrees F. (about 204 degrees C. to about 510 degrees C.), preferably ranging from about 650 degrees F. to about 850 degrees F. (about 343 degrees C. to about 454 degrees C.).

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300 degrees F. to about 750 degrees F. (about 150 degrees C. to about 400 degrees C.), preferably ranging from 450 degrees F. to 600 degrees F. (230 degrees C. to about 315 degrees C.).

Hydrotreating may also be used as a final step in the lube base oil manufacturing process. This final step, commonly called hydrofinishing, is intended to improve the UV stability and appearance of the product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. Clay treating to remove these impurities is an alternative final process step.

Oligomerization

Depending upon how the Fischer-Tropsch synthesis is carried out, the Fischer-Tropsch derived products will contain varying amounts of olefins. In addition, most Fischer-Tropsch condensate will contain some alcohols which may be readily converted into olefins by dehydration. These olefins may be hydrogenated during the hydrotreating or hydrofinishing processes already discussed to form alkanes. However, in some instances, such as when low molecular weight olefins comprise a significant proportion of the feedstock, it may be advantageous to oligomerize the olefins to produce hydrocarbons of higher average molecular weight. During oligomerization the lighter olefins are not only converted into heavier products, but the carbon backbone of the oligomers will also display branching at the points of molecular addition. Due to the introduction of branching into the molecule, the pour point of the products is reduced.

The oligomerization of olefins has been well reported in the literature, and a number of commercial processes are available. See, for example, U.S. Pat. Nos. 4,417,088; 4,434,308; 4,827,064; 4,827,073; and 4,990,709. Various types of reactor configurations may be employed, with the fixed catalyst bed reactor being used commercially. More recently, performing the oligomerization in an ionic liquids media has been proposed, since these catalysts are very active, and the contact between the catalyst and the reactants is efficient and the separation of the catalyst from the oligomerization products is facilitated. Preferably, the oligomerized product will have an average molecular weight at least 10 percent higher than the initial feedstock, more preferably at least 20 percent higher. The oligomerization reaction will proceed over a wide range of conditions. Typical temperatures for carrying out the reaction are between about 32 degrees F. (0 degrees C.) and about 800 degrees F. (425 degrees C.). Other conditions include a space velocity from 0.1 to 3 LHSV and a pressure from 0 to 2000 psig. Catalysts for the oligomerization reaction can be virtually any acidic material, such as, for example, zeolites, clays, resins, $BF_3$ complexes, HF, $H_2SO_4$, $AlCl_3$, ionic liquids (preferably ionic liquids containing a Bronsted or Lewis acidic component or a combination of Bronsted and Lewis acid components), transition metal-based catalysts (such as $Cr/SiO_2$), superacids, and the like. In addition, non-acidic oligomerization catalysts including certain organometallic or transition metal oligomerization catalysts may be used, such as, for example, zirconocenes.

Distillation

The separation of the Fischer-Tropsch derived products into the various fractions used in the process of the invention is generally conducted by either atmospheric or vacuum distillation or by a combination of atmospheric and vacuum distillation. Atmospheric distillation is typically used to separate the lighter distillate fractions, such as naphtha and middle distillates, from a bottoms fraction having an initial boiling point above about 700 degrees F. to about 750 degrees F. (about 370 degrees C. to about 400 degrees C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions.

As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column.

First and Second Distillate Fractions

Both the first distillate fraction and the second distillate fraction used to prepare the lubricating base oil product of the invention represent distillate fractions of the Fischer-Tropsch derived product as defined above. One skilled in the art will recognize that additional distillate fractions apart from the first and second distillate fractions also may be added to the final blend provided the target properties, mainly viscosity and volatility, are achieved. Distillate fractions used in carrying out the invention may be characterized by their true boiling point (TBP) and their boiling range distribution. For the purposes of this disclosure, unless stated otherwise, TBP and boiling range distributions for a distillate fraction are measured by gas chromatography according to ASTM D-6352 or its equivalent.

A critical property of the distillate fractions of the invention is viscosity. The first distillate fraction must have a viscosity of about 2 or greater but less than 3 cSt at 100 degrees C., more preferably between about 2.1 and 2.8 cSt at 100 degrees C., and most preferably between about 2.2 and 2.7 cSt at 100 degrees C. The second distillate fraction of the invention is characterized by a viscosity of about 3.8 cSt or greater at 100 degrees C., preferably between about 3.8 cSt and about 12 cSt at 100 degrees C. The second distillate fraction actually will fall into one of several different categories which are defined by different viscosity ranges. The first category has a viscosity range of between about 3.8 cSt and about 8 cSt at 100 degrees C., more preferably between either about 3.8 cSt and about 5 cSt or alternatively between about 5.8 cSt and 6.6 cSt at 100 degrees C. A second category has a viscosity which falls within the range of from greater than about 8 cSt to about 10 cSt at 100 degrees C. A third category has a viscosity which falls within the range from greater than about 10 cSt to about 12 cSt at 100 degrees C. The blending in of a distillate fraction having a viscosity above 3 cSt but less than 3.8 cSt at 100 degrees C. is undesirable because the viscosity of the final product would be below the target, i.e. a viscosity of blend of at least 3 cSt at 100 degrees C. Consequently such blends are outside of the scope of the present invention.

One skilled in the art will recognize that more than a single distillate fraction characterized as having a viscosity of greater than 3.8 cSt at 100 degrees C., referred to as second distillate fractions, may be blended into the lubricating base oil while remaining within the target viscosity range of the blend. For example, an acceptable Fischer-Tropsch derived lubricating base oil may be prepared by blending the light first distillate fraction with two different distillate fractions each having a different viscosity of between about 3.8 and about 12 cSt at 100 degrees C. In this instance, the lighter of the two fractions, referred to for convenience as the second distillate fraction, may have a viscosity of between about 3.8 and about 5 cSt at 100 degrees C. The other distillate fraction, referred to as a Fischer-Tropsch derived third distillate fraction, will have a higher viscosity, generally between about 6 cSt and about 12 cSt at 100 degrees C. Obviously the proportions of the various fractions in the blend will need to be adjusted to meet the desired target viscosity of the lubricating base oil.

The exact ratio of each of the fractions in the final blend will depend on the exact viscosity of each fraction and the target viscosity desired for the lubricating base oil. It is also possible to blend three or even more 3.8 cSt plus fractions with the first distillate fraction to prepare the lubricating base oil. Such blends are intended to be included within the scope of the present invention.

Another critical property of the distillate fractions and the lubricating base oil products of the invention is volatility which is expressed as Noack volatility, Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D-5800). A more convenient method for calculating Noack volatility and one which correlates well with ASTM D-5800 is by using a thermo gravimetric analyzer test (TGA) by ASTM D-6375. TGA Noack volatility is used throughout this disclosure unless otherwise stated. As already noted above, the first distillate fraction of the invention while having a viscosity below 3 cSt at 100 degrees C. displays a significantly lower TGA Noack volatility than would be expected when compared to conventional petroleum-derived distillates having a comparable viscosity. This makes it possible to blend the low viscosity first distillate fraction with the higher viscosity second distillate fraction and still meet the volatility specifications for the lube base oil and the finished lubricant.

Lubricating Base Oil

Lubricating base oils are generally materials having a viscosity greater than 3 cSt at 100 degrees C.; a pour point below 20 degrees C., preferably below 0 degrees C.; and a VI of greater than 70, preferably greater than 90. As explained below and illustrated in the examples, the lubricating base oils prepared according to the process of the present invention meet these criteria. In addition, the lubricating base oils of the invention display a unique combination of properties which could not have been predicted from a review of the prior art relating to both conventional and Fischer-Tropsch materials. The invention takes advantage of the high VI of the light distillate fraction which when blended with the heavier fractions will result in a final blend having a viscosity which is within acceptable limits for use as a lubricating base oil.

The lubricating base oil formed by the blending of the first and second distillate fractions is characterized as having a viscosity between about 3 and about 10 cSt at 100 degrees C. and a TGA Noack volatility of less than about 35 weight percent. Generally, the lubricating base oil will have a viscosity between about 4 cSt and 5 cSt at 100 degrees C. and a Noack volatility greater than about 12 weight percent. Commonly the Noack volatility will be greater than about 20 weight percent. Volatility of the Fischer-Tropsch derived lubricating base oils of the invention are acceptable and are comparable to conventional petroleum derived lubricating base oils which is surprising given the low viscosity of the first distillate fraction. The use of a comparable petroleum derived base oil in a lubricating base oil blend would result in an unacceptably high Noack volatility. Generally, the viscosity index (VI) of the Fischer-Tropsch derived lubricating base oil will be between about 130 and about 175. VI is an expression of the effect of temperature on viscosity, and it is surprising that a lubricating base oil prepared using a base oil having a viscosity of less than 3 cSt at 100 degrees C. will be characterized by such a favorable VI. Since Fischer-Tropsch derived hydrocarbons are typically very low in total sulfur, the total sulfur content of the lubricating base oil usually will be less than about 5 ppm. Conventionally- derived, solvent processed lubricating base oils will generally display much higher sulfur levels, usually in excess of 2000 ppm.

Lubricating base oils prepared by blending a second distillate fraction having a viscosity falling within the range of from about 3.8 cSt and about 8.5 cSt at 100 degrees C. will generally have a boiling range distribution of at least 300 degrees F. (167 degrees C.) between the 5 percent and 95 percent points (by ASTM D-6352 or its equivalent). By contrast lubricating base oils prepared from a second distillate fraction having a viscosity falling within the viscosity range of from about 7 to about 12 cSt at 100 degrees C. will have a boiling range distribution of at least 350 degrees F. (167 degrees C.) between the 5 percent and 95 percent points (by ASTM D-6352 or its equivalent). Commonly the boiling range distribution of this blend between the 5 percent and the 95 percent points will be at least 400 degrees F. (about 222 degrees C.). In addition, when the second distillate fraction used to prepare the blend has a viscosity within the range from about 7 to about 12 cSt at 100 degrees C., the Fischer-Tropsch derived lubricating base oil will have an initial boiling point within the range of between about 550 degrees F. and about 625 degrees F, an end boiling point between about 1000 degrees F. and about 1400 degrees F., and wherein less than 20 weight percent of the blend boils within the region defined by the 50 percent boiling point, plus or minus 25 degrees F. The boiling range distribution of the lubricating base oils of the invention are significantly broader than those observed for conventional lubricating base oils. The boiling range for conventionally derived lubricating base oils typically will not exceed about 250 degrees F. (about 139 degrees C.). In this disclosure when referring to boiling range distribution, the boiling range between the 5 percent and 95 percent boiling points is what is referred to.

Pour point is the temperature at which a sample of the lubricating base oil will begin to flow under carefully controlled conditions. In this disclosure, where pour point is given, unless stated otherwise, it has been determined by standard analytical method ASTM D-5950. Lubricating base oils prepared according to the present invention have excellent pour points which are comparable or even below the pour points observed for conventionally derived lubricating base oils. Finally, due to the extremely low aromatics and multi-ring naphthene levels of blends of Fischer-Tropsch derived lubricating base oils, their oxidation stability far exceeds that of conventional lubricating base oil blends.

In addition to blending the first and second distillate fractions (and optionally including a third distillate fraction) to prepare the lubricating base oil, a Fisher-Tropsch bottoms fraction having a viscosity between about 9 cSt and about 20 cSt, more preferably between about 10 cSt and about 16 cSt, at 100 degrees C. may be blended into the lubricating base oil composition. These heavy bottoms fractions would not be expected to lower the viscosity or raise the Noack volatility outside of the minimum specifications for these measurements. It is also possible to blend conventional petroleum derived base oils, such as conventional Neutral Group I and Group II base oils, into the lubricating base oil if so desired. Due to the excellent cold flow properties, low sulfur content, and high oxidative stability of the Fischer-Tropsch derived materials, they make ideal blending stock for upgrading conventional base oils.

Finished Lubricants

Finished lubricants generally comprise a lubricating base oil and at least one additive. Finished lubricants are used in automobiles, diesel engines, axles, transmissions, and industrial applications. As noted above, finished lubricants must meet the specifications for their intended application as defined by the concerned governing organization. Lubricating base oils of the present invention have been found to be suitable for formulating finished lubricants intended for many of these applications. For example, lubricating base oils of the present invention may be formulated to meet SAE J300, June 2001 specifications for 5W-XX, 10W-XX, and 15W-XX multi-grade crankcase lubricating oils. Multi-grade crankcase oils meeting 5W-XX and 10W-XX may be formulated using only Fischer-Tropsch lubricating base oils prepared according to the present invention. However, in order to meet the specifications for some 10W-XX and most 15W-XX, it is likely that the Fischer-Tropsch derived lubricating base oil must be blended with a conventional petroleum derived lubricating base oil, such as a conventional Neutral Group I or Group II base oil to meet the specifications. Typically, when present the conventional Neutral Group I or Group II base oil will comprise from about 40 to about 90 weight percent of the lubricating base oil blend, more preferably from about 40 to about 70 weight percent. In addition, Fischer-Tropsch derived lubricating base oils of the invention may be used to formulate finished lubricants meeting the specifications for automatic transmission fluids and ISO Viscosity Grade 22, 32, and 46 industrial oils.

The lubricating base oil compositions of the invention may also be used as a blending component with other oils. For example, the Fischer-Tropsch derived lubricating base oils may be used as a blending component with synthetic base oils, including polyalpha-olefins, diesters, polyol esters, or phosphate esters, to improve the viscosity and viscosity index properties of those oils. The Fischer-Tropsch derived base oils may be combined with isomerized petroleum wax. They may also be used as workover fluids, packer fluids, coring fluids, completion fluids, and in other oil field and well-servicing applications. For example, they can be used as spotting fluids to release a drill pipe which has become stuck, or they can be used to replace part or all of the expensive polyalphaolefin lubricating additives in downhole applications. Additionally, Fischer-Tropsch derived lubricating base oils may be used in drilling fluid formulations where shale-swelling inhibition is important, such as described in U.S. Pat. No. 4,941,981.

Additives which may be blended with the lubricating base oil to form the finished lubricant composition include those which are intended to improve certain properties of the finished lubricant. Typical additives include, for example, anti-wear additives, detergents, dispersants, antioxidants, pour point depressants, VI improvers, friction modifiers, demulsifiers, antifoaming agents, corrosion inhibitors, seal swell agents, and the like. Other hydrocarbons, such as those described in U.S. Pat. Nos. 5,096,883 and 5,189,012, may be blended with the lubricating base oil provided that the finished lubricant has the necessary pour point, kinematic viscosity, flash point, and toxicity properties. Typically, the total amount of additives in the finished lubricant will fall within the range of from about 1 to about 30 weight percent. However due to the excellent properties of the Fischer-Tropsch derived lubricating base oils of the invention, less additives than required with conventional petroleum derived base oils may be required to meet the specifications for the finished lubricant. The use of additives in formulating finished lubricants is well documented in the literature and well within the ability of one skilled in the art. Therefore, additional explanation should not be necessary in this disclosure.

EXAMPLES

The following examples are included to further clarify the invention but are not to be construed as limitations on the scope of the invention.

Example 1

A Fisher-Tropsch distillate fraction (designated FTBO-2.5) having a viscosity between 2 and 3 cSt at 100 degrees C. was analyzed and its properties were compared to two commercially available conventional petroleum derived oils (Nexbase 3020 and Pennzoil 75HC) having viscosities within the same general range. A comparison between the properties of the three samples is shown below:

| | FTBO-2.5 | Nexbase 3020 | Pennzoil 75HC |
|---|---|---|---|
| Viscosity at 100 degrees C. (cSt) | 2.583 | 2.055 | 2.885 |
| Viscosity Index (VI) | 133 | 96 | 80 |
| Pour Point, C. | −30 | −51 | −38 |
| TGA Noack Volatility (wt. percent) | 48.94 | 70 | 59.1 |

It should be noted that, although the viscosity at 100 degrees C. of the Fischer-Tropsch derived material was comparable to those of the conventional oils, the VI is surprisingly high, which results in a much lower volatility for a given viscosity.

Example 2

Three different Fischer-Tropsch derived lubricating base oils were prepared by blending different proportions of the FTBO-2.5 from example 1 with a Fischer-Tropsch base oil having a viscosity of 4.455 at 100 degrees C. (designated FTBO-4.5). The properties of FTBO-4.5 were as follows:

| | |
|---|---|
| Viscosity at 100 degrees C. (cSt) | 4.455 |
| Viscosity Index (VI) | 147 |
| Pour Point, C. | −20 |

The proportions of FTBO-2.5 and FTBO-4.5 in each blend were as shown in Table 1 below:

TABLE 1

| | Wt % FTBO-2.5 | Wt % FTBO-4.5 |
|---|---|---|
| Lubricating Base Oil A | 50 | 50 |
| Lubricating Base Oil B | 52.2 | 47.8 |
| Lubricating Base Oil C | 55.9 | 44.1 |

The properties for each of the three lubricating base oil blends are summarized in Table 2 below:

TABLE 2

| | Lubricating Base Oil A | Lubricating Base Oil B | Lubricating Base Oil C |
|---|---|---|---|
| D-6352 Simulated TBP (WT %), ° F. | | | |
| TBP @ 0.5 (Initial Boiling Point) | 601 | 601 | 601 |
| TBP @ 5 | 624 | 624 | 623 |

TABLE 2-continued

| | Lubricating Base Oil A | Lubricating Base Oil B | Lubricating Base Oil C |
|---|---|---|---|
| TBP @ 10 | 642 | 641 | 639 |
| TBP @ 20 | 676 | 674 | 671 |
| TBP @ 30 | 710 | 707 | 702 |
| TBP @ 50 | 783 | 777 | 767 |
| TBP @ 70 | 857 | 853 | 844 |
| TBP @ 90 | 931 | 929 | 925 |
| TBP @ 95 | 955 | 954 | 952 |
| TBP @ 99.5 | 979 | 979 | 979 |
| Boiling Range Distribution (5–95) | 331 | 330 | 329 |
| Viscosity at 40° C. | 18.86 | 18.25 | 17.21 |
| Viscosity at 100° C. | 4.52 | 4.401 | 4.222 |
| Viscosity Index | 162 | 160 | 158 |
| Pour Point, ° C. | | −18 | −22 |
| CCS at −35° C., cP* | | 1715 | 1476 |
| TGA Noack | 26.61 | 26.8 | 29.62 |

*This property represents cold-cranking simulator (CCS) apparent viscosity which is a measure of low temperature cold-cranking in automobile engines determined by ASTM D-5293.

It should be noted that all three Fischer-Tropsch blends had volatility, as measured by TGA Noack, which was suitable for blending engine oils. It should also be noted that the VI of each of the three blends was higher than the VI of either FTBO-2.5 or FTBO-4.5.

Example 3

The properties of the Fischer-Tropsch derived lubricating base oils as shown in Table 2 above may be compared to the properties of commercially available petroleum derived conventional Group I and Group II Light Neutral base oils as summarized in Table 3 below.

TABLE 3

| | Chevron Texaco 100R | Gulf Coast Solvent 100 | Gulf Coast H.P. 100 | Exxon Americas Core 100 |
|---|---|---|---|---|
| API Base Oil Category (API 1509 E.1.3) | II | I | II | I |
| D-6352 Simulated TBP (WT %), ° F. | | | | |
| TBP @ 5 | 659 | | | 647 |
| TBP @ 10 | 677 | | | 672 |
| TBP @ 20 | 703 | | | 703 |
| TBP @ 30 | 723 | | | 725 |
| TBP @ 50 | 756 | | | 761 |
| TBP @ 70 | 786 | | | 796 |
| TBP @ 90 | 825 | | | 839 |
| TBP @ 95 | 842 | | | 858 |
| TBP @ 99.5 | 878 | | | 907 |
| Boiling Range Distribution (5–95) | 219 | | | 211 |
| Viscosity at 40° C. | 20.0 | 20.4 | 20.7 | 20.2 |
| Viscosity at 100° C. | 4.1 | 4.1 | 4.1 | 4.04 |
| Viscosity Index | 102 | 97 | 97 | 95 |
| Pour Point, ° C. | −14 | −18 | −15 | −19 |
| CCS at −25° C., cP | 1450 | 1430 | 1550 | 1513 |
| CCS at −35° C., cP | >3000 | >3000 | >3000 | >3000 |
| Noack Volatility, wt % | 26 | 29 | 25.5 | 29.3 |

A comparison of Table 2 and 3 illustrate that the Fischer-Tropsch derived lubricating base oils have a similar Noack volatility and kinematic viscosity at 100 degrees C. to conventional Group 1 and Group 11 Light Neutral oils. The Fischer-Tropsch derived lubricating base oils of the invention also display significantly better VI, lower pour points, and lower CCS viscosity which are desirable properties for blending engine oils.

Example 4

Four different Fischer-Tropsch derived lubricating base oils of the invention were prepared by blending different proportions of the FTBO-2.5 from Example 1 with a Fischer-Tropsch base oil having a viscosity of 7.953 at 100 degrees C. (designated FTBO-8). The properties of FTBO-8 were as follows:

| | |
|---|---|
| Viscosity at 100 degrees C. (cSt) | 7.953 |
| Viscosity Index (VI) | 165 |
| Pour Point, degrees C. | −12 |

The proportions of FTBO-2.5 and FTBO-8 in each blend were as shown in Table 4 below:

TABLE 4

| | Wt % FTBO-2.5 | Wt % FTBO-8 |
|---|---|---|
| Lubricating Base Oil D | 10 | 90 |
| Lubricating Base Oil E | 25 | 75 |
| Lubricating Base Oil F | 50 | 50 |
| Lubricating Base Oil G | 75 | 25 |

The properties for each of the four lubricating base oil blends are summarized in Table 5 below:

TABLE 5

| | Lubricating Base Oil D | Lubricating Base Oil E | Lubricating Base Oil F | Lubricating Base Oil G |
|---|---|---|---|---|
| D-6352 Simulated TBP (WT %), ° F. | | | | |
| TBP @ 0.5 (Initial Boiling Point) | 616 | 600 | 595 | 594 |
| TBP @ 5 | 711 | 650 | 630 | 621 |
| TBP @ 10 | 810 | 691 | 652 | 636 |
| TBP @ 20 | 847 | 775 | 693 | 664 |
| TBP @ 30 | 869 | 838 | 734 | 691 |
| TBP @ 50 | 916 | 892 | 826 | 745 |
| TBP @ 70 | 980 | 960 | 906 | 807 |
| TBP @ 90 | 1094 | 1080 | 1041 | 956 |
| TBP @ 95 | 1156 | 1145 | 1110 | 1038 |
| TBP @ 99.5 | 1333 | 1334 | 1314 | 1243 |
| Boiling Range Distribution (5–95) | 445 | 495 | 480 | 417 |
| Wt % Within 50% TBP +/− 25° F. | 19 | 17 | 12 | 18 |
| Viscosity at 100° C., cSt | 7.4 | 5.9 | 4.4 | 3.6 |
| VI | 166 | 168 | 160 | 148 |

It will be noted that all four blends have a boiling range distribution between the 5 percent and 95 percent boiling points of greater than 400 degrees F. and that less than 20 weight percent of the blend boils within the region defined by the 50percent boiling point, plus or minus 25 degrees F. It should also be noted that all of the blends display viscosity and VI that well within the range for lubricating base oils.

What is claimed is:

1. A process for producing a Fischer-Tropsch derived lubricating base oil which comprises:

a) recovering a Fischer-Tropsch derived product;

b) separating the Fischer-Tropsch derived product into at least a first distillate fraction and a second distillate fraction, said first distillate fraction being characterized by a viscosity of about 2 cSt or greater but less than 3 cSt at 100 degrees C. and said second distillate fraction being characterized by a viscosity of about 3.8 cSt or greater at 100 degrees C.; and c) blending the first distillate fraction with the second distillate fraction in the proper proportion to produce a Fischer-Tropsch derived lubricating base oil characterized as having a viscosity of between about 3 and about 10 cSt at 100 degrees C. and a TGA Noack volatility of less than about 35 weight percent.

2. The process of claim 1 wherein the first distillate fraction has a viscosity between about 2.1 and 2.8 cSt at 100 degrees C.

3. The process of claim 2 wherein the first distillate fraction has a viscosity between about 2.2 and 2.7 cSt at 100 degrees C.

4. The process of claim 1 wherein the second distillate fraction has a viscosity of between about 4 and about 12 cSt at 100 degrees C.

5. The process of claim 1 wherein the second distillate fraction has a viscosity of between about 3.8 to about 8 cSt at 100 degrees C.

6. The process of claim 5 wherein the second distillate fraction has a viscosity of between about 3.8 to about 5 cSt at 100 degrees C.

7. The process of claim 6 wherein the Fischer-Tropsch derived lubricating base oil has a viscosity of between about 4.2 and about 4.8 cSt at 100 degrees C.

8. The process of claim 6 including the additional step of blending into the Fischer-Tropsch derived lubricating base oil a third Fischer-Tropsch derived distillate fraction having a viscosity between 6 cSt to about 12 cSt at 100 degrees C.

9. The process of claim 5 wherein the second distillate fraction has a viscosity of between about 5.8 and about 6.6 at 100 degrees C.

10. The process of claim 4 wherein the second distillate fraction has a viscosity within the range of from greater than about 8 to about 10 cSt at 100 degrees C.

11. The process of claim 4 wherein the second distillate fraction has a viscosity within the range of from greater than about 10 to about 12 cSt at 100 degrees C.

12. The process of claim 1 wherein a bottoms fraction having a viscosity of between about 9 and about 20 cSt at 100 degrees C. is blended with the first and second distillate fractions.

13. The process of claim 12 wherein the bottoms fraction has a viscosity of between about 10 and about 16 cSt at 100 degrees C.

14. The process of claim 1 wherein the Fischer-Tropsch derived lubricating base oil has a viscosity of between about 4 and about 5 cSt at 100 degrees C.

15. The process of claim 1 wherein the TGA Noack volatility of the Fischer-Tropsch derived lubricating base oil is greater than 12 weight percent.

16. The process of claim 1 including the additional step of blending the Fischer-Tropsch lubricating base oil with at least one additive to produce a finished lubricant.

17. The process of claim 1 including the additional step of blending the Fischer-Tropsch lubricating base oil with from about 40 weight percent to about 90 weight percent of a conventional Neutral Group I or Group II lubricating base oil based upon the total blend.

18. The process of claim 17 wherein the Fischer-Tropsch lubricating base oil is blended with from about 40 weight percent to about 70 weight percent of the conventional Neutral Group I or Group II lubricating base oil based upon the total blend.

19. A lubricating base oil product which comprises a Fischer-Tropsch derived lubricating base oil prepared according to the process comprising the steps of:

a) recovering a Fischer-Tropsch derived product;

b) separating the Fischer-Tropsch derived product into at least a first distillate fraction and a second distillate fraction, said first distillate fraction being characterized by a viscosity of about 2 or greater but less than 3 cSt at 100 degrees C. and said second distillate fraction being characterized by a viscosity of between about 3.8 cSt and about 8.5 cSt at 100 degrees C.; and c) blending the first distillate fraction with the second distillate fraction in the proper proportion to produce the Fischer-Tropsch derived lubricating base oil characterized as having a viscosity of between about 3 and about 8 cSt at 100 degrees C. and a TGA Noack volatility of less than about 35 weight percent.

20. The Fischer-Tropsch derived lubricating base oil of claim 19 having a boiling range distribution of at least 300 degrees F. (167 degrees C.) between the 5 percent and 95 percent points by analytical method D-6352 or its equivalent.

21. The Fischer-Tropsch lubricating base oil of claim 19 wherein the TGA Noack volatility is 12 weight percent or greater.

22. The Fischer-Tropsch lubricating base oil of claim 21 wherein the TGA volatility is greater than about 20 weight percent.

23. The Fischer-Tropsch lubricating base oil of claim 19 wherein the VI is between about 130 and about 175.

24. The Fischer-Tropsch lubricating base oil of claim 19 wherein the total sulfur content is less than about 5 ppm.

25. The lubricating base oil product of claim 19 further comprising from about 40 weight percent to about 90 weight percent of a conventional Neutral Group I or Group II lubricating base oil based upon the final blend.

26. The lubricating base oil product of claim 25 further comprising from about 40 weight percent to about 70 weight percent of a conventional Neutral Group I or Group II lubricating base oil based upon the final blend.

27. A finished lubricant comprising the lubricating base oil product of claim 19 and at least one additive.

28. The finished lubricant of claim 27 which is a multigrade crankcase lubricating oil meeting SAE J300, June 2001, specifications.

29. The finished lubricant of claim 28 meeting the specifications for 5W-XX.

30. The finished lubricant of claim 28 meeting the specifications for 10W-XX.

31. The finished lubricant of claim 28 further comprising a conventional Neutral Group I or Group II lubricating base oil.

32. The finished lubricant of claim 31 meeting the specifications for 10W-XX.

33. The finished lubricant of claim 31 meeting the specifications for 15W-XX.

34. A lubricating base oil product comprising a Fischer-Tropsch derived lubricating base oil prepared by a process comprising the steps of:

a) recovering a Fischer-Tropsch product;

b) separating the Fischer-Tropsch derived product into at least a first distillate fraction and a second distillate fraction, said first distillate fraction being characterized by a viscosity of about 2 or greater but less than 3 cSt at 100 degrees C. and said second distillate fraction being characterized by a viscosity of between about 7 and about 12 cSt at 100 degrees C.; and c) blending the first distillate fraction with the second distillate fraction in the proper proportion to produce a Fischer-Tropsch derived lubricating base oil characterized as having a viscosity of between about 3 and about 9 cSt at 100 degrees C. and a TGA Noack volatility of less than 35 weight percent.

35. The Fischer-Tropsch derived lubricating base oil of claim 34 wherein a bottoms fraction having a viscosity of between about 12 and about 20 cSt at 100 degrees C. is blended with the first and second distillate fractions.

36. The Fischer-Tropsch derived lubricating base oil of claim 34 having a boiling range distribution of at least 350 degrees F. between the 5 percent and 95 percent points by analytical method D-6352 or its equivalent.

37. The Fischer-Tropsch derived lubricating base oil of claim 36 having a boiling range distribution of at least 400 degrees F. between the 5 percent and 95 percent points by analytical method D-6352 or its equivalent.

38. The Fischer-Tropsch derived lubricating base oil of claim 34 wherein the viscosity is between about 4 and about 8 cSt at 100 degrees C.

39. The Fischer-Tropsch derived lubricating base oil of claim 38 wherein the viscosity is between about 4 and about 5 cSt at 100 degrees C.

40. The Fischer-Tropsch lubricating base oil of claim 34 wherein the TGA Noack volatility is 12 weight percent or greater.

41. The Fischer-Tropsch lubricating base oil of claim 40 wherein the TGA Noack volatility is greater than 20 weight percent.

42. The Fischer-Tropsch lubricating base oil of claim 34 wherein the VI is between about 130 and about 175.

43. The Fischer-Tropsch lubricating base oil of claim 34 wherein the total sulfur content is less than about 5 ppm.

44. The lubricating base oil product of claim 34 further including from about 40 weight percent to about 90 weight percent of a conventional Neutral Group I or Group II lubricating base oil based on the final blend.

45. The lubricating base oil product of claim 44 including from about 40 weight percent to about 70 weight percent of a conventional Neutral Group I or Group II lubricating base oil based on the final blend.

46. A finished lubricant comprising the lubricating base oil product of claim 34 and at least one additive.

47. The finished lubricant of claim 46 which is a multigrade crankcase lubricating oil meeting SAE J300, June 2001, specifications.

48. The finished lubricant of claim 47 meeting the specifications for 5W-XX.

49. The finished lubricant of claim 47 meeting the specifications for 10W-XX.

50. The finished lubricant of claim 46 further including a conventional Neutral Group I or Group II lubricating base oil.

51. The finished lubricant of claim 50 meeting the specifications for 10W-XX.

52. The finished lubricant of claim 46 meeting the specifications for 15W-XX.

53. A lubricating base oil product having a viscosity between about 3 cSt and about 10 cSt comprising a Fischer-Tropsch derived lubricating base oil that is characterized by a viscosity of between about 3 and about 9 cSt at 100 degrees C.; a TGA Noack volatility of less than 35 weight percent; an initial boiling point within the range of between about 550 degrees F. and about 625 degrees F.; an end boiling point between about 1000 degrees F. and about 1400 degrees F.; and wherein less than 20 weight percent of the blend boils within the region defined by the 50 percent boiling points, plus or minus 25 degrees F.

54. The Fischer-Tropsch derived lubricating base oil of claim 53 having a boiling range distribution of at least 350 degrees F. between the 5 percent and 95 percent points by analytical method D-6352 or its equivalent.

55. The Fischer-Tropsch derived lubricating base oil of claim 54 having a boiling range distribution of at least 400 degrees F. between the 5 percent and 95 percent points by analytical method D-6352 or its equivalent.

56. The Fischer-Tropsch derived lubricating base oil of claim 53 wherein the viscosity is between about 4 and about 5 cSt at 100 degrees C.

57. The Fischer-Tropsch lubricating base oil of claim 53 wherein the TGA Noack volatility is 12 weight percent or greater.

58. The Fischer-Tropsch lubricating base oil of claim 57 wherein the TGA Noack volatility is greater than 20 weight percent.

59. The Fischer-Tropsch lubricating base oil of claim 53 wherein the VI is between about 130 and about 175.

60. The Fischer-Tropsch lubricating base oil of claim 53 wherein the total sulfur content is less than about 5 ppm.

* * * * *